US008498875B2

(12) United States Patent
Sung et al.

(10) Patent No.: US 8,498,875 B2
(45) Date of Patent: Jul. 30, 2013

(54) APPARATUS AND METHOD FOR ENCODING AND DECODING ENHANCEMENT LAYER

(75) Inventors: Jongmo Sung, Seoul (KR); Do-Young Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 837 days.

(21) Appl. No.: 12/673,536

(22) PCT Filed: Aug. 18, 2008

(86) PCT No.: PCT/KR2008/004775

§ 371 (c)(1),
(2), (4) Date: Feb. 15, 2010

(87) PCT Pub. No.: WO2009/022884

PCT Pub. Date: Feb. 19, 2009

(65) Prior Publication Data

US 2011/0106532 A1 May 5, 2011

(30) Foreign Application Priority Data

Aug. 16, 2007 (KR) ..... 10-2007-0082346
Mar. 18, 2008 (KR) ..... 10-2008-0024919
Aug. 14, 2008 (KR) ..... 10-2008-0079929

(51) Int. Cl.
*G10L 21/00* (2006.01)

(52) U.S. Cl.
USPC ..... 704/500; 704/219; 375/240.24

(58) Field of Classification Search
USPC ..... 704/219, 500; 375/240.24
See application file for complete search history.

(56) References Cited

U.S. PATENT DOCUMENTS 6,650,762 B2 11/2003 Gibson et al.
6,724,814 B1 4/2004 Green et al.

(Continued)

FOREIGN PATENT DOCUMENTS

JP 11-68577 3/1999
JP 2003-218701 7/2003

(Continued)

OTHER PUBLICATIONS

Series G: Transmission Systems and Media, Digital Systems and Networks, Digital terminal equipments—Coding of analogue signals by pulse code modulation, "Wideband embedded extension of G.711 pulse code modulation" Mar. 2008, International Telecommunication Union, pp. 1-74.
Yusuke Hiwasaki, "A G.711 Embedded Wideband Speech Coding for VoIP Conferences" IEICe Trans. INF. & Syst., vol. E89-D, No. 9, Sep. 2006, pp. 2542-2552.

(Continued)

*Primary Examiner* — Daniel D Abebe
(74) *Attorney, Agent, or Firm* — Staas & Halsey LLP

(57) ABSTRACT

Provided is a method and apparatus for encoding and decoding an enhancement layer to reduce quantization error in a G.711 codec. Exponent indices of additional mantissa information of each sample are calculated based upon exponent information of each sample in a frame. A process of allocating 1 bit to each sample with a current exponent index is repeated, the exponent index starting from the maximum value while decreasing by 1 at every repetition until the total number of bits allocated to the samples is equal to the total number of available bits in the frame. And the most significant bits, as many as the number of bits allocated to each sample, are extracted from the additional mantissa information of each sample in the frame.

33 Claims, 8 Drawing Sheets

U.S. PATENT DOCUMENTS

| | | | | |
|---|---|---|---|---|
| 6,785,261 | B1 | 8/2004 | Schuster et al. | |
| 7,424,051 | B2 | 9/2008 | Green et al. | |
| 2005/0259729 | A1 | 11/2005 | Sun | |
| 2006/0251169 | A1 | 11/2006 | Wang | |
| 2009/0076830 | A1 * | 3/2009 | Taleb | 704/500 |
| 2010/0191538 | A1 * | 7/2010 | Kovesi et al. | 704/500 |

FOREIGN PATENT DOCUMENTS

| | | |
|---|---|---|
| JP | 2005-208320 | 8/2005 |
| KR | 10-0152054 | 12/1998 |
| KR | 10-2004-0050811 | 6/2004 |
| KR | 10-2004-0062261 | 7/2004 |
| KR | 10-2005-0051046 | 6/2005 |
| WO | 92/12607 | 7/1992 |

OTHER PUBLICATIONS

"Pulse Code Modulation (PCM) of Voice Frequencies," ITU-T Recommendation G.711, Extract from the *Blue Book*, Fascicle 111.4, 1988.

Yusuke Hiwasaki, et al., A G.711 Embedded Wideband Speech Coding for VoIP Conferences, IEICE Trans. Inf. & Syst., vol. E89-D, No. 9, Sep. 2006, pp. 2542-2552.

"An Efficient Embedded ADPCM Coder," S.D. Zhang et al., Telecommunications, Mar. 26-28, 1995, Conference Publication No. 404, pp. 210-214.

"Variable Rate ADPCM Coding of Speech Based on Explicit Noise Coding," N.S. Jayant, Proc. of IEEE-Globecom Conf., San Diego, CA, Nov. 1983, pp. 188-192.

* cited by examiner

FIG. 4A

| EXPONENT INDEX \ SAMPLE INDEX | 0 | 1 | 2 | 3 | . . . . . | 39 |
|---|---|---|---|---|---|---|
| 0 | | | | | | |
| 1 | | | | | | |
| 2 | | | | | | |
| 3 | | | 2 | | | |
| 4 | | 1 | 2 | | | |
| 5 | | 1 | 2 | | . . . . . | |
| 6 | 0 | 1 | | | | 39 |
| 7 | 0 | | | | | 39 |
| 8 | 0 | | | | | 39 |
| 9 | | | | | | |

APPARATUS AND METHOD FOR ENCODING AND DECODING ENHANCEMENT LAYER

REFERENCE TO RELATED APPLICATIONS

This application claims the benefit under 35 U.S.C. Section 371, of PCT International Application No. PCT/KR2008/004775, filed Aug. 18, 2008, which claimed priority to Korean Application Nos. 10-2007-0082346, filed Aug. 16, 2007, 10-2008-0024919, filed Mar. 18, 2008, and 10-2008-0079929, filed Aug. 14, 2008, the entire disclosures of which are incorporated by reference as a part of this application.

TECHNICAL FIELD

The present invention relates to a G.711 encoder and decoder, and more particularly, to a method of encoding and decoding an enhancement layer to reduce a quantization error in a G.711 codec.

BACKGROUND ART

It is difficult to directly apply a technology of sampling an analog voice signal and converting the sampled analog voice signal into a digital signal to the application with a limited bandwidth due to a relatively high bit rate. For example, a speech signal that is sampled at 8 KHz and quantized to 16 bits per sample, will result in a bit rate of 128,000 bits per second (bps). In order to effectively transmit a speech signal at a low bit rate in most communication networks, a codec apparatus for compressing and decompressing the speech signal is used.

Examples of a method of compressing and decompressing a speech signal include pulse coded modulation (PCM) and code-excited linear prediction (CELP). PCM is a method of compressing a respective voice sample to a predetermined number of bits, whereas CELP is a method of framing a speech signal into blocks and compressing the speech signal on the basis of a speech production model. Various codecs have been developed and standardized in a wide range of fields. One of the most widely used codecs is a log PCM codec that is adopted on a public switched telephone network (PSTN), internet telephony, and so on. The log PCM codec varies a quantization step depending on the magnitude of an input signal. That is, the log PCM codec uses a small quantization step when the level of an input signal is low, and uses a large quantization step when the level of an input signal is high. The log PCM codec can compress a digital sample with 16 bits per sample to a codeword with 8 bits per sample. Accordingly, if a signal is sampled at 8 KHz, a bit rate of 64,000 bps is obtained using the log PCM codec. There are two main coding laws, which are A-law and μ-law. The respective laws are expressed as $$C_\mu(|x|) = \frac{\log_{10}(1+\mu|x|)}{\log_{10}(1+\mu)} \tag{1}$$

$$C_A(|x|) = \begin{cases} \dfrac{1+\log_{10}(A|x|)}{1+\log_{10}(A)} & \text{for } |x| > \dfrac{1}{A} \\ \dfrac{A|x|}{1+\log_{10}(A)} & \text{for } |x| \le \dfrac{1}{A} \end{cases}$$

where x is an input sample, The μand A are constants for the respective coding laws, C( ) is a sample value compressed by each coding law, and || is an absolute value operation.

The A-law and u-law have been standardized as ITU-T (International Telecommunication Union-Telecommunication Sector) Recommendation G.711 since 1972. The values of μand A in the G.711 are 255 (μ) and 87.56 (A), respectively. The G.711 codec actually uses a floating point quantization method, rather than directly calculates Equation 1. Among available bits per sample (e.g., 8 bits for the G.711), some bits are used to determine a quantization step and the remaining bits are used to express a position in the quantization step. The former bits are exponent bits and the latter bits are mantissa bits. In the A-law of the G.711, 3 bits are used for the exponent, 4 bits are used for the mantissa, and the remaining 1 bit is used to express a sign of a sample.

The G.711 provides a high quality of about 4 MOS (Mean Opinion Score) for narrowband speech, with less computational complexity and memory requirements. However, there is still quality degradation caused by quantization error, compared with an original speech signal.

BRIEF DESCRIPTION OF THE DRAWINGS

FIGS. 4A and 4B illustrate an exponent maps for dynamically calculating the number of bits for additional mantissa information of each sample in a frame depending on the magnitude of an input signal according to an embodiment of the present invention;

DETAILED DESCRIPTION OF THE INVENTION

Technical Problem

Figure 1:
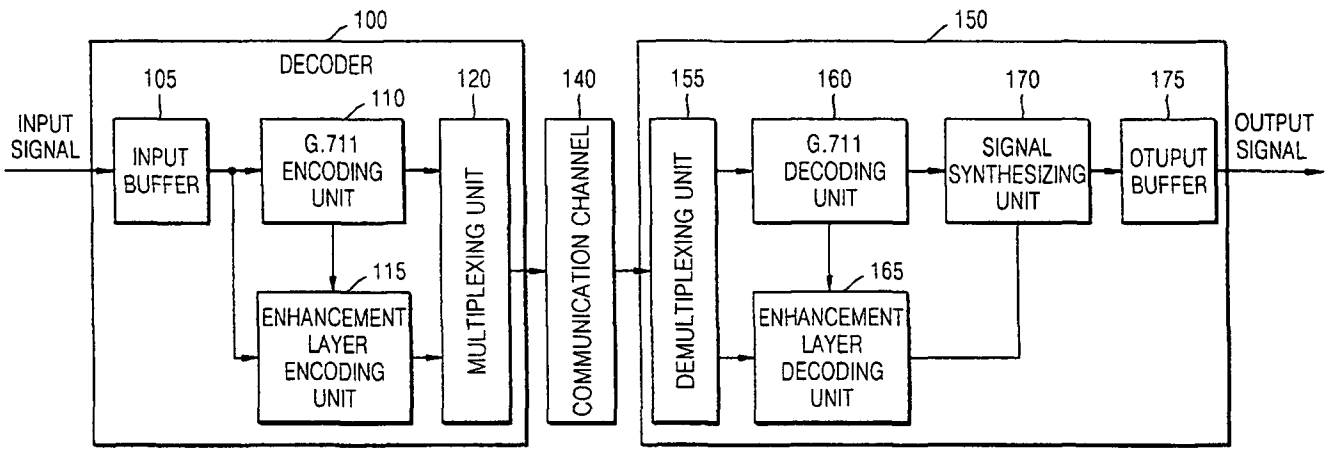
FIG. 1 is a block diagram of an encoder and a decoder for quality improvement of speech in a G.711 codec.

The present invention provides an apparatus and method for encoding and decoding an enhancement layer, which can reduce quantization error in a G.711 codec by adding extra bits to each G.711-coded sample.

The present invention also provides an enhancement layer encoder and decoder which can reduce quantization error in a G.711 codec.

Technical Solution

According to an aspect of the present invention, there is provided a method of encoding an enhancement layer, the method comprising: calculating exponent indices of additional mantissa information of each sample based on exponent information of each sample in a frame; repeating a process of allocating 1 bit to all of samples with a current exponent index starting from the maximum value while decreasing by 1 at every repetition until the total number of bits allocated to the samples is equal to the total number of available bits in the frame; and extracting the most significant bit(s), as many as the number of bit(s) allocated to each sample, from the additional mantissa information of each sample in the frame.

According to another aspect of the present invention, there is provided an enhancement layer encoder comprising: an exponent map generating unit generating an exponent map that is a matrix, including exponent indices of additional mantissa information derived from exponent value of each sample and sample indices for each sample in a frame; a bit allocation table generating unit generating a bit allocation table containing the number of bits allocated to each sample by referring to the exponent map, in the way of repeating a process of allocating 1 bit to each sample with a respective exponent index starting from the maximum value while decreasing by 1 at every repetition until the total number of bits allocated to the samples is equal to the total number of available bits in the frame; and a bit output unit outputting the most significant bit(s), as many as the number of the bit(s) allocated to each sample, from the additional mantissa information of each sample, by referring to the bit allocation table.

According to another aspect of the present invention, there is provided an encoder comprising: a G.711 encoding unit encoding an input frame; an enhancement layer encoding unit encoding the input frame in the way dynamically allocating the number of bits for additional mantissa information to each sample in the input frame based on a exponent information of each sample which is obtained from the G.711 encoding unit; and a multiplexing unit multiplexing bitstream of the G.711 encoding unit and bitstream of the enhancement layer encoding unit.

According to another aspect of the present invention, there is provided a method of decoding an enhancement layer, the method comprising: calculating exponent indices of additional mantissa information of each sample in a frame based on exponent information of each sample; repeating a process of allocating 1 bit to each sample with a current exponent index starting from the maximum while decreasing by 1 at every repetition until the total number of bits allocated to the samples is equal to the total number of available bits in the frame; and extracting an additional mantissa bit(s), as many as the number of bits allocated to each sample, from an enhancement bitstream and decoding the extracted additional mantissa bit(s).

According to another aspect of the present invention, there is provided an enhancement layer decoder comprising: an exponent map generating unit generating an exponent map that is a matrix, including exponent indices of additional mantissa information derived from exponent value of each sample and sample indices for each sample in a frame; a bit allocation table generating unit generating a bit allocation table containing the number of bits allocated to each sample by referring to the exponent map, in the way of repeating a process of allocating 1 bit to each sample with a respective exponent index starting from the maximum value while decreasing by 1 at every repetition until the total number of bits allocated to the samples is equal to the total number of available bits in the frame; and an additional mantissa decoding unit extracting an additional mantissa bit(s), as many as the number of bit(s) allocated to each sample, from an enhancement bitstream by referring to the bit allocation table and decoding the additional mantissa bits.

According to another aspect of the present invention, there is provided a decoder comprising: a demultiplexing unit demultiplexing a received frame to a G.711 bitstream and an enhancement bitstream; a G.711 decoding unit decoding the G.711 bitstream; an enhancement layer decoding unit calculating the number of bits for additional mantissa information allocated to each sample using exponent value of each sample obtained from the G.711 decoding unit, extracting an additional mantissa bit(s), as many as the number of bits allocated to each sample, from an enhancement bitstream, and decoding the extracted additional mantissa bit(s); and a signal synthesizing unit combining an output signal of the G.711 decoding unit and an output signal of the enhancement layer decoding unit to output the synthesized signal.

According to another aspect of the present invention, there is provided a method of encoding an enhancement layer in a hierarchical encoding combined with a base layer including exponent information and mantissa information of a sample, the method comprising: calculating the number of allocated bits for additional mantissa information to extend the mantissa information; and encoding the additional mantissa information according to the number of the allocated bits, wherein the calculating the number of allocated bits is adaptively performed by referring to exponent information of samples existing in an interval of predetermined length.

According to another aspect of the present invention, there is provided a method of decoding an enhancement layer signal in a hierarchically encoded bitstream comprising a base layer bitstream, which includes exponent information and mantissa information of a sample, and an enhancement layer bitstream, which includes additional mantissa information of the sample, the method comprising: calculating the number of bits allocated to each sample for the additional mantissa information, based upon the exponent information extracted from the base layer bitstream; and extracting the additional mantissa information of the calculated number of the bits allocated to each sample from the enhancement layer bitstream.

Advantageous Effects

As described above, according to the present invention, since additional bits for mantissa information are dynamically allocated to each sample by using exponent information obtained from a conventional log PCM codec like a conventional G.711 codec, a quantization error resulting from the log PCM codec can be reduced and the quality of speech can be improved. Also, since the present invention does not change the conventional log PCM codec, compatibility with a network employing an existing log PCM codec can be achieved.

BEST MODE

According to an aspect of the present invention, there is provided a method of encoding an enhancement layer, the method comprising: calculating exponent indices of additional mantissa information of each sample based on exponent information of each sample in a frame; repeating a process of allocating 1 bit to all of samples with a current exponent index starting from the maximum value while decreasing by 1 at every repetition until the total number of bits allocated to the samples is equal to the total number of available bits in the frame; and extracting the most significant bit(s), as many as the number of bit(s) allocated to each sample, from the additional mantissa information of each sample in the frame.

According to another aspect of the present invention, there is provided an enhancement layer encoder comprising: an exponent map generating unit generating an exponent map that is a matrix, including exponent indices of additional mantissa information derived from exponent value of each sample and sample indices for each sample in a frame; a bit allocation table generating unit generating a bit allocation table containing the number of bits allocated to each sample by referring to the exponent map, in the way of repeating a process of allocating 1 bit to each sample with a respective exponent index starting from the maximum value while decreasing by 1 at every repetition until the total number of bits allocated to the samples is equal to the total number of available bits in the frame; and a bit output unit outputting the most significant bit(s), as many as the number of the bit(s) allocated to each sample, from the additional mantissa information of each sample, by referring to the bit allocation table.

According to another aspect of the present invention, there is provided an encoder comprising: a G.711 encoding unit encoding an input frame; an enhancement layer encoding unit encoding the input frame in the way dynamically allocating the number of bits for additional mantissa information to each sample in the input frame based on a exponent information of each sample which is obtained from the G.711 encoding unit; and a multiplexing unit multiplexing bitstream of the G.711 encoding unit and bitstream of the enhancement layer encoding unit.

According to another aspect of the present invention, there is provided a method of decoding an enhancement layer, the method comprising: calculating exponent indices of additional mantissa information of each sample in a frame based on exponent information of each sample; repeating a process of allocating 1 bit to each sample with a current exponent index starting from the maximum while decreasing by 1 at every repetition until the total number of bits allocated to the samples is equal to the total number of available bits in the frame; and extracting an additional mantissa bit(s), as many as the number of bits allocated to each sample, from an enhancement bitstream and decoding the extracted additional mantissa bit(s).

According to another aspect of the present invention, there is provided an enhancement layer decoder comprising: an exponent map generating unit generating an exponent map that is a matrix, including exponent indices of additional mantissa information derived from exponent value of each sample and sample indices for each sample in a frame; a bit allocation table generating unit generating a bit allocation table containing the number of bits allocated to each sample by referring to the exponent map, in the way of repeating a process of allocating 1 bit to each sample with a respective exponent index starting from the maximum value while decreasing by 1 at every repetition until the total number of bits allocated to the samples is equal to the total number of available bits in the frame; and an additional mantissa decoding unit extracting an additional mantissa bit(s), as many as the number of bit(s) allocated to each sample, from an enhancement bitstream by referring to the bit allocation table and decoding the additional mantissa bits.

According to another aspect of the present invention, there is provided a decoder comprising: a demultiplexing unit demultiplexing a received frame to a G.711 bitstream and an enhancement bitstream; a G.711 decoding unit decoding the G.711 bitstream; an enhancement layer decoding unit calculating the number of bits for additional mantissa information allocated to each sample using exponent value of each sample obtained from the G.711 decoding unit, extracting an additional mantissa bit(s), as many as the number of bits allocated to each sample, from an enhancement bitstream, and decoding the extracted additional mantissa bit(s); and a signal synthesizing unit combining an output signal of the G.711 decoding unit and an output signal of the enhancement layer decoding unit to output the synthesized signal.

According to another aspect of the present invention, there is provided a method of encoding an enhancement layer in a hierarchical encoding combined with a base layer including exponent information and mantissa information of a sample, the method comprising: calculating the number of allocated bits for additional mantissa information to extend the mantissa information; and encoding the additional mantissa information according to the number of the allocated bits, wherein the calculating the number of allocated bits is adaptively performed by referring to exponent information of samples existing in an interval of predetermined length.

According to another aspect of the present invention, there is provided a method of decoding an enhancement layer signal in a hierarchically encoded bitstream comprising a base layer bitstream, which includes exponent information and mantissa information of a sample, and an enhancement layer bitstream, which includes additional mantissa information of the sample, the method comprising: calculating the number of bits allocated to each sample for the additional mantissa information, based upon the exponent information extracted from the base layer bitstream; and extracting the additional mantissa information of the calculated number of the bits allocated to each sample from the enhancement layer bitstream.

MODE OF THE INVENTION

A method and apparatus for encoding and decoding an enhancement layer and an enhancement layer encoder and decoder according to the present invention will now be described more fully with reference to the accompanying drawings, in which exemplary embodiments of the invention are shown.

FIG. 1 is a block diagram of an encoder 100 and a decoder 150 for improving the quality of speech in a G.711 codec.

Referring to FIG. 1, the encoder 100 includes an input buffer 105, a G.711 encoding unit 110, an enhancement layer encoding unit 115, and a multiplexing unit 120. The decoder 150 includes a demultiplexing unit 155, a G.711 decoding unit 160, an enhancement layer decoding unit 165, a signal synthesizing unit 170, and an output buffer 175. The encoder 100 is connected to the decoder 150 through a communication channel 140.

The encoder 100 will be first explained.

The input buffer 105 stores a block of input samples with a predetermined size in order to process an input signal in block-by-block. For example, when an input signal is sampled at 8 KHz and processed at every 5 ms frame, the input buffer 105 stores 40 samples (=8 KHz*5 ms). The G.711 encoding unit 110 encodes the frame stored in the input buffer 105 using the conventional G.711 codec, and outputs a G.711 bitstream. Since the G.711 is a well-known codec standardized by the ITU-T, a detailed explanation thereof will not be given here. The enhancement layer encoding unit 115 encodes a quantization error, which is not represented by the G.711 encoding unit 110, using additional bits and outputs an enhancement bitstream. The multiplexing unit 120 multiplexes the G.711 bitstream of the G.711 encoding unit 110 and the enhancement bitstream of the enhancement layer encoding unit 115. The multiplexed bitstream is transmitted to the decoder 150 through the communication channel 140.

The decoder 150 will now be explained.

The demultiplexing unit 155 demultiplexes the multiplexed bitstream received from the encoder 100 through the communication channel 140 to a G.711 bitstream and an enhancement bitstream. The G.711 decoding unit 160 decodes the G.711 bitstream by using the G.711 codec and outputs a G.711 decoded signal. The enhancement layer decoding unit 165 decodes the enhancement bitstream and outputs an enhancement layer decoded signal. The signal synthesizing unit 170 combines the G.711 decoded signal from the G.711 decoding unit 160 and the enhancement layer decoded signal from the enhancement layer decoding unit 165 and outputs a a synthesized signal. The output buffer 175 stores the synthesized signal from the signal synthesizing unit 170, and outputs the stored signal in frame-by-frame.

Figure 2:
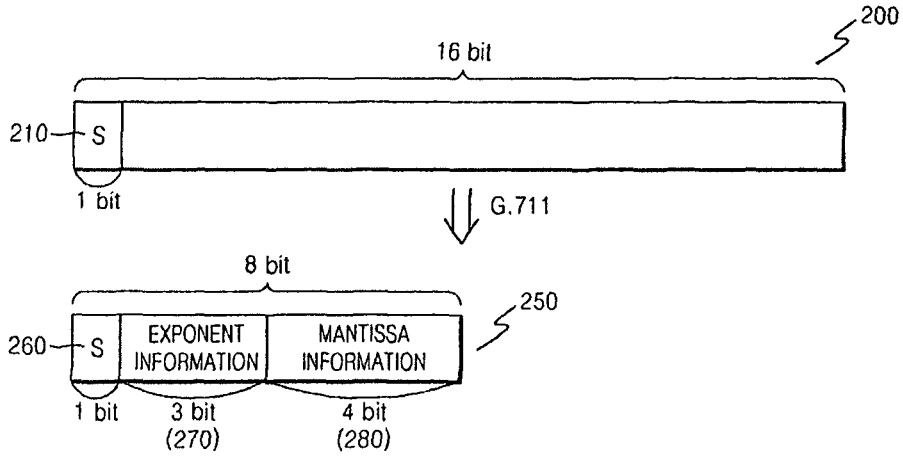
FIG. 2 is a schematic view illustrating an input sample and an output bitstream of an encoder to which a log pulse coded modulation (PCM) codec of a conventional G.711 codec is applied.
Figure 3:
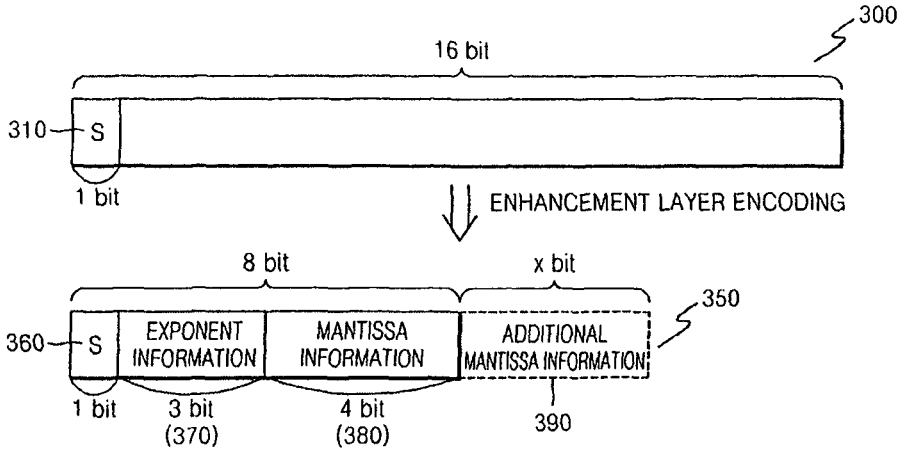
FIG. 3 is a schematic view illustrating an input sample and an output bitstream of an encoder to which enhancement layer encoding according to the present invention is applied.

FIG. 2 is a schematic view illustrating an input bitstream and an output bitstream of an encoder to which a log PCM codec of a conventional G.711 codec is applied. FIG. 3 is a schematic view illustrating an input bitstream and an output bitstream of an encoder to which enhancement layer encoding according to the present invention is applied.

Referring to FIG. 2, of the conventional G.711 encoder compresses a 16-bit input sample 200 to an 8-bit sample 250. The 8-bit sample 250 is composed of 1-bit sign information 260, 3-bit exponent information 270, and 4-bit mantissa information 280. The exponent information 270 indicates a compander segment, and the mantissa information 280 indicates a position in the segment indicated by the exponent information 270.

Referring to FIG. 3, when enhancement layer encoding according to the present invention is used, a coded sample includes additional mantissa information 390 as well as a G.711-coded sample of 8 bits. The additional mantissa information 390 sub-divides a specific position indicated by mantissa information 380 in a segment indicated by exponent information 370, thereby reducing quantization error resulted from the G.711 codec.

When a bit rate of the enhancement layer is 16 Kbit/s and the enhancement layer operates on 5 ms frame, the total number of available bits for enhancement layer per frame is 80 bits. That is, when the number of samples in the frame is 40 samples, an additional 2 bits per sample can be allocated on the average. Since a quantization error in the G.711 codec depends on the magnitude of an input signal, it is preferable to dynamically allocating the number of bits for additional mantissa information of each sample according to the magnitude of each sample, rather than to allocate the same number of bits for the additional mantissa information of each sample.

In the case where 3 bits per sample are allocated to additional mantissa information in order to reduce quantization error further, the total number of bits of all samples in a frame i.e. 120 bits (40 samples*3 bits) exceeds the available 80 bits. In this regard, bits ranging from 0 to 3 are allocated to the additional mantissa information based on the exponent value of each sample. Of course, the maximum number of bits per sample for the additional mantissa information may be set to 3, or more, or less, depending upon embodiments of the present invention.

Figure 4B:
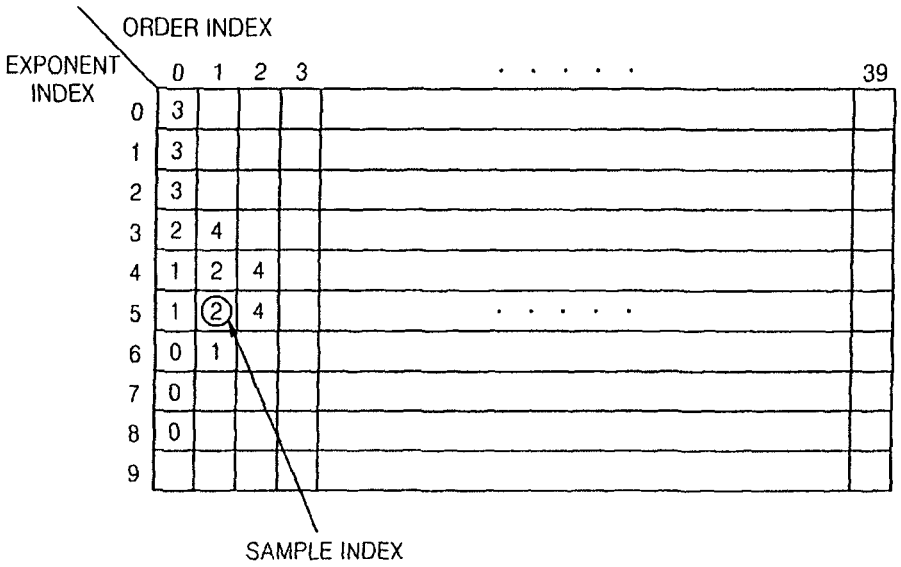

FIGS. 4A and 4B illustrate exponent maps for dynamically allocating the number of bits of additional mantissa information to each sample in a frame depending on the magnitude of an input sample according to an embodiment of the present invention.

Referring to FIG. 4A, the exponent map is a matrix in which row indices are exponent indices of additional mantissa information derived from an exponent value of each sample and column indices are sample indices representing each sample. For example, when 0 to 3-bits for additional mantissa information are allocated to each sample in a frame of 40 samples, the exponent map is a 10×40 matrix.

In detail, exponent indices of each sample are proportional to the exponent value of each sample, are sequential, and the number of the exponent indices are the same as the number of bits of additional mantissa information. That is, exponent indices are obtained by incrementing the exponent value of each sample. For example, when the exponent value of a sample is "000" in binary, exponent indices corresponding to the sample are 0 (the exponent value+0), 1 (the exponent value+1), and 2 (the exponent value+2). As another example, when the exponent value is 7 ("111" in binary), exponent indices are 7 (the exponent value+0), 8 (the exponent value+1), and 9/the exponent value+2). Accordingly, exponent indices of each sample for additional exponent information can range from 0 to 9.

All of elements in an exponent map are initialized to −1, and elements corresponding to an exponent index of a sample store a sample index. That is, (an exponent index, a sample index)=a sample index. For example, when the exponent value of the second sample in a frame is "011", possible exponent indices of the sample are 3, 4, and 5. From this, elements corresponding to the exponent indices 3, 4, 5, i.e., (3,2), (4,2), (5,2) are set to 2, respectively. And the remaining elements in a column of the sample index remain intact.

By repeating the procedure to seta sample index to corresponding elements for all samples in a frame, the exponent map is established. A bit allocation table indicating the number of additional bits allocated to each sample is created based on the exponent map. That is, 1 bit is allocated to each sample corresponding to the current exponent index which starts from the maximum value (i.e., 9) while decreasing by 1. The bit allocation is performed until the total number of bits allocated to the samples is equal to the available bits in a frame. The generation of the bit allocation table will be explained in detail later with reference to FIG. 5.

Referring to FIG. 4B, an exponent map is a matrix in which row indices are exponent indices of additional mantissa information derived from the exponent value of each sample and column indices are order indices indicating the number of samples with the same exponent index. Each of elements of the exponent map represents a sample index with an exponent index.

For example, in the case where the maximum number of bits for additional mantissa information is 3 and there are 40 samples in a frame, the exponent map would be a 10×40 matrix since all of samples in a frame can have the common exponent index.

A method of generating an exponent map with respect to an n-th sample will now be explained.

First, exponent indices of additional mantissa information of the n-th sample are obtained based on its exponent value. That is, the exponent indices of the n-th sample are (its exponent value+j), where j=0, 1, and 2.

Once three exponent indices of the n-th sample are obtained, an index of the n-th sample is stored in elements corresponding to the exponent indices and order indices representing the current number of samples with the exponent indices, respectively. That is, (an exponent index, the current number of samples with the exponent index)=an index of the n-th sample. The current numbers of the samples with the exponent indices are increased by 1, respectively.

For example, when the exponent value of the 0-th sample in a frame is "110" in binary, the corresponding exponent indices are 6, 7, and 8. Elements corresponding to the exponent indices 6, 7, and 8, i.e., (6,0), (7,0), (8,0), are set to sample index 0, and the current numbers of samples with the exponent indices 6, 7, and 8 are set to 1, respectively. Next, when the exponent value of the 1-st sample is "100" in binary, the corresponding exponent indices are 4, 5, and 6. Elements corresponding to the exponent indices 4, 5, and 6, i.e., (4,0), (5,0), (6,1) are set to sample index 1. The reason why the (6,1)-th element is set to 1 is that the number of samples having the exponent index of 6 is already 1 in the previous sample. Accordingly, the numbers of the samples corresponding to the exponent indices 4, 5, 6, 7, and 8 are 1, 1, 2, 1, and 1, respectively. When the exponent map is completely generated in this way for all samples, the number of samples and sample indices corresponding to each exponent index can be obtained.

Figure 5:
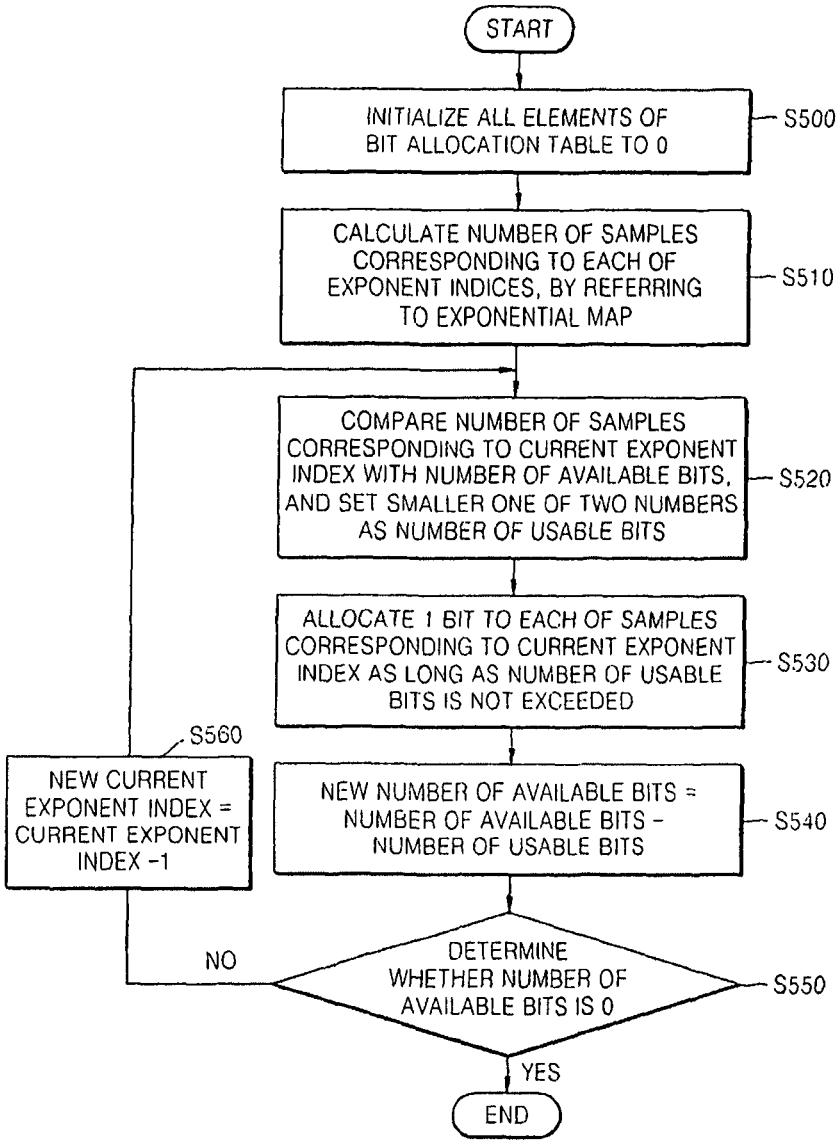
FIG. 5 is a flowchart illustrating a method of generating a bit allocation table according to an embodiment of the present invention.

FIG. 5 is a flowchart illustrating a method of generating a bit allocation table according to an embodiment of the present invention.

Referring to FIG. 5, when it is assumed that the maximum number of additional bits per sample is 3 and the total number of available bits per frame is 80, an enhancement layer encoder outputs additional mantissa information to each sample based on an exponent value of each sample.

In detail, in operation S500, the enhancement layer encoder initializes all elements of a bit allocation table to 0, sets current available bits to the total number of available bits in a current frame, and sets a maximum value of the exponent indices as a current exponent index. In operation S510, the enhancement layer encoder calculates the number of samples corresponding to each exponent index, by referring to the exponent maps illustrated in FIGS. 4A and 4B. For example, there are two samples, whose sample indices are 0 and 39, corresponding to an exponent index 8 in the exponential map illustrated in FIG. 4A.

In operation S520, the enhancement layer encoder compares the number of samples corresponding to the current exponent index with current available bits, and then sets the smaller one of the two numbers as the number of usable bits. In operation S530, 1 bit is allocated to each sample corresponding to the current exponent index until the number of the usable bits is exhausted. In operation S540, the enhancement layer encoder sets a value subtracting the number of the usable bits from the current available bits as a new number of current available bits.

In operation S550, it is checked whether the current available bits are 0. If the current available bits are 0, the generation of a bit allocation table ends for the frame. If the current available bits are not 0, the enhancement layer proceeds to operation S560. In operation S560, the enhancement layer encoder updates the current exponent index by decrementing the current exponent index by 1, and returns to operation S520. Then the enhancement layer encoder repeats operations from S520 to S550.

Figure 6:
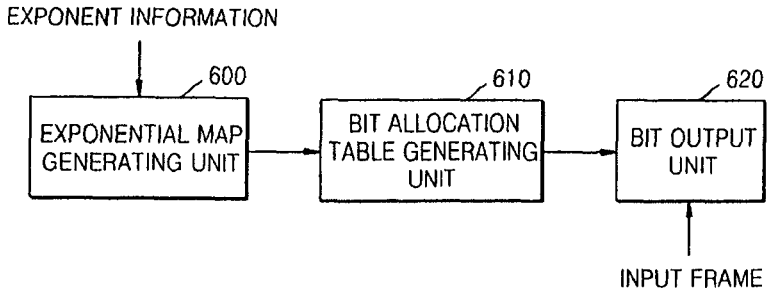
FIG. 6 is a block diagram of an enhancement layer encoder according to an embodiment of the present invention.

FIG. 6 is a block diagram of an enhancement layer encoder according to an embodiment of the present invention.

Referring to FIG. 6, the enhancement layer encoder includes an exponent map generating unit 600, a bit allocation table generating unit 610, and a bit output unit 620. The enhancement layer encoder corresponds to an enhancement layer encoding unit 115 illustrated in FIG. 1.

The exponent map generating unit 600 computes exponent indices of additional mantissa information per sample based on the exponent value of each sample, and then generates an exponent map including the exponent indices of each sample. The exponent value of each sample can be extracted from the G.711 encoding unit 110 illustrated in FIG. 1. Since the exponent map is illustrated in FIGS. 4A and 4 B, a detailed explanation thereof will not be given here.

Referring to the exponent map, the bit allocation table generating unit 610 retrieves samples corresponding to each exponent index and allocates 1 bit to the retrieved samples by sequentially decrementing the exponent index by 1 from the maximum value. When this bit allocation procedure is completed for all of exponent indices, the bit allocation table generating unit 610 generates a bit allocation table containing the number of bits allocated to each sample. A method of generating the bit allocation table is illustrated in FIG. 5.

The bit output unit 620 outputs the most significant bits of the additional mantissa information in amount of the number of the bits allocated to each sample in an input frame by using the bit allocation table. That is, the bit output unit 620 outputs [the additional mantissa information]/(2^ [the number of the bits of the additional mantissa information−the allocated number of the bits]).

Figure 7:
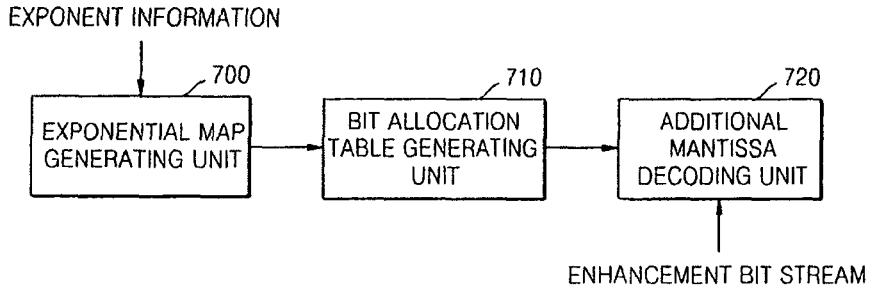
FIG. 7 is a block diagram of an enhancement layer decoder according to an embodiment of the present invention.

FIG. 7 is a block diagram of an enhancement layer decoder according to an embodiment of the present invention.

Referring to FIG. 7, the enhancement layer decoder includes an exponent map generating unit 700, a bit allocation table generating unit 710, and an additional mantissa decoding unit 720. The exponent map generating unit 700 and the bit allocation table generating unit 710 are the same as the exponent map generating unit 600 and the bit allocation table generating unit 610 illustrated in FIG. 6, and thus a detailed explanation thereof will not be given here.

The additional mantissa decoding unit 720 extracts and decodes additional mantissa information of each sample from an enhancement bitstream based on the number of bits of the additional mantissa information allocated to each sample.

Figure 8:
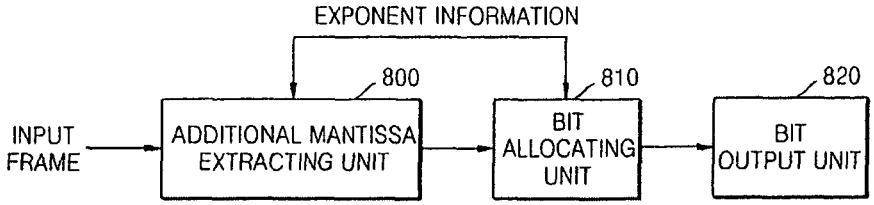
FIG. 8 is a block diagram of an enhancement layer encoder according to another embodiment of the present invention.

FIG. 8 is a block diagram of an enhancement layer encoder according to another embodiment of the present invention.

Referring to FIG. 8, the enhancement layer encoder includes an additional mantissa extracting unit 800, a bit allocating unit 810, and a bit output unit 820.

The additional mantissa extracting unit 800 extracts additional mantissa information from an input frame based on an exponent value obtained from the G.711 encoding performed on the input frame. That is, the additional mantissa extracting unit 800 extracts some bits followed by mantissa information (i.e., G.711 mantissa information of 4 bits) as additional mantissa information, based on the exponent value obtained from the G.711 encoding performed on the input frame. Although all of bits followed by the mantissa information may be the additional mantissa information, it is assumed in FIG. 8 that the maximum number of bits of the additional mantissa information is 3 in the current embodiment. In this case, a pseudo-code for the additional mantissa extracting unit 800 is as follows.

```
for(i=0; i<L; i++)
{
  ext_bits[i]=exp[i]+3;
  ext_mantissa[i]=x[i] & (2^ext_bits[i]−1);
}
```

wherein L is the number of samples in a frame, exp[i] is an exponent value of an i-th sample, ext_bits[i] is the number of bits of additional mantissa information of the i-th sample, ext_mantissa[i] is the additional mantissa information of the i-th sample, x[i] is the i-th sample, and "&" is a bitwise AND operation.

For example, suppose that an input sample is "0000 0001 1010 1001" in binary. The input sample is encoded in G.711 A-law, which is a combination of a sign bit of "1", exponent bits of "001", and mantissa bits of "1010". Also the resulting additional mantissa information is "100", assuming that the maximum number of bits of additional mantissa information is 3.

The bit allocating unit 810 calculates the number of bits allocated to each sample by using the total number of available bits and exponent values of each sample. For example, if the bit-rate of an enhancement layer is 16 Kbit/s and the frame size is 5 ms, the total number of available bits per frame is 80 bits. The bit allocating unit 810 dynamically computes the number of bits for additional mantissa information per each sample based on the priorities of the additional mantissa information of each sample with criterion to minimize quantization error in each frame. For example, the priority may be determined from the exponent value of each sample which means a quantization step in a G.711 codec. In other words, since a sample with relatively larger exponent value results in more quantization error, its priority is higher so that more additional bits are allocated to the sample. A sample with a relatively smaller exponent value has a lower priority so that less additional bits are allocated to the sample because its quantization error is less.

The bit output unit 820 outputs the additional mantissa information in amount of the number of the bits allocated to each sample computed by the bit allocating unit 810. A pseudo-code for the bit output unit 820 is as follows.

```
for(i=0; i<L; i++)
{
  tx_bit_enh[i]=ext_mantissa[i]>>(ext_bits[i]-bit_alloc[i]);
}
```

wherein bit_alloc[i] is the number of bits allocated to the i-th sample, tx_bit_enh[i] is an coded enhancement bitstream of the i-th sample, and x>>a" is an operation in which "x" is right-shifted by "a" bits.

For example, in the case where additional mantissa information of a sample is "100" and the number of bits allocated is 2 bits, the bit output unit 820 outputs "10" as its encoded enhancement bitstream.

In the embodiment, it is exemplified that the maximum number of bits per sample for additional mantissa information is extracted from the sample, and then is truncated to allocated number of bits for the sample. However, it is possible that the allocated number of bits is extracted from a sample after a bit allocation table is established, in another embodiment.

Figure 9:
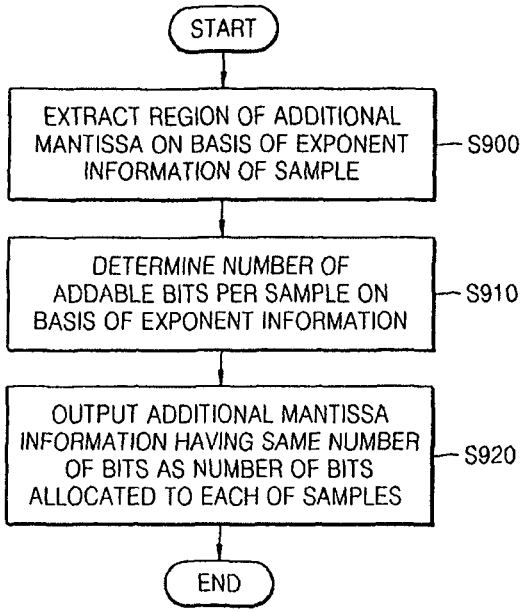
FIG. 9 is a flowchart illustrating a method of encoding an enhancement layer according to an embodiment of the present invention.

FIG. 9 is a flowchart illustrating a method of an enhancement layer encoding according to an embodiment of the present invention.

Referring to FIG. 9, in operation S900, an enhancement layer encoder extracts additional mantissa information based on an exponent value obtained from the G.711 encoding performed on the input frame. Although the additional mantissa information may be the whole remaining bits followed by mantissa information in the input frame, it is assumed in FIG. 9 that the maximum number of bits for the additional mantissa information is 3 in the current embodiment. Accordingly, the enhancement layer encoder extracts additional mantissa information of 3 bits only.

In operation S910, the enhancement layer encoder computes the number of additional bits for mantissa information per sample by using the exponent value obtained from the G.711 encoding. In detail, the enhancement layer encoder sets priorities for 3 respective bits of the additional mantissa information of each sample as being proportional to the exponent value of each sample. For example, an exponent index may be used as a priority as shown in FIGS. 4A and 4B. The enhancement layer encoder sequentially allocates 1 bit to samples with from the highest priority to the lowest priority until a total number of allocated bits exceeds a total number of available bits in the frame.

In operation S920, after the number of bits allocated to each sample is obtained in this way, the enhancement layer encoder outputs the most significant bits of the additional mantissa information in amount of the number of the bits allocated to each sample in an input frame.

Figure 10:
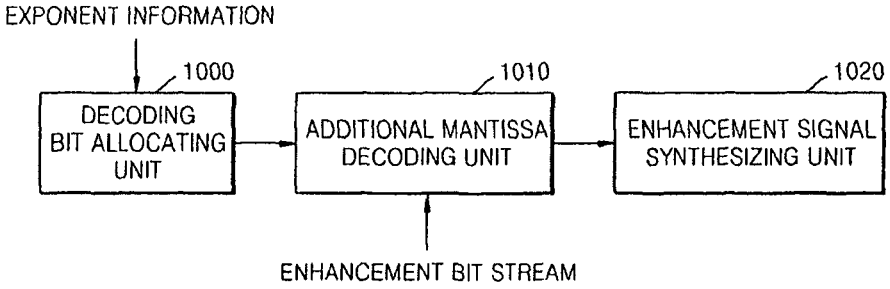
FIG. 10 is a block diagram of an enhancement layer decoder according to another embodiment of the present invention.

FIG. 10 is a block diagram of an enhancement layer decoder according to another embodiment of the present invention.

Referring to FIG. 10, the enhancement layer decoder includes a decoder bit allocating unit 1000, an additional mantissa decoding unit 1010, and an enhancement signal synthesizing unit 1020.

The decoder bit allocating unit 1000 obtains the number of bits for additional mantissa information per sample by using the total number of available bits in a frame and exponent values obtained by G.711 decoding. The operation of the decoder bit allocating unit 1000 is the same as that of the bit allocating unit illustrated in FIG. 7, and thus a detailed explanation thereof will not be given here.

The additional mantissa decoding unit 1010 restores additional mantissa information from an enhancement bitstream, using the exponent value and the number of the bits for the additional mantissa information obtained by the decoder bit allocating unit 1000. That is, the additional mantissa decoding unit 1010 restores the additional mantissa information by extracting the same number of bits as the number of the bits of the additional mantissa information allocated to each sample from the enhancement bitstream. When the maximum number of the bits for the additional mantissa information is 3, a pseudo-code for operating the additional mantissa decoding unit 1010 is shown below. That is, the additional mantissa decoding unit 1010 inserts a bit string of "0"s to the decoded additional mantissa information in amount of difference between the maximum number of bits for the additional mantissa information and the number of allocated bits for the additional mantissa information.

```
for(i=0; i<L; i++)
{
  ext_mantissa[i]=rx_bits_enh[i]<<(3 - bit_alloc[i]);
}
```

wherein rx_bit_enh[i] is the i-th enhancement bitstream.

The enhancement signal synthesizing unit 1020 restores an enhancement signal by using the restored additional mantissa information, exponent value and sign information obtained by G.711 decoding. A pseudo-code for operating the enhancement signal synthesizing unit 1020 is as follows. At first, the restored additional mantissa information is bit-shifted to left in amount of the exponent value, and then sign information is added in the way that if the sign information indicates a negative value, the bit-shifted additional mantissa information is multiplied by (−1), and otherwise, the bit-shifted additional mantissa information itself is an enhancement sample.

```
for(i=0; i<L; i++)
{
  sig_enh[i] = ext_mantissa[i] << exp[i];
  if(sign[i]=negative value)
    sig_enh[i]=-sig_enh[i];
}
```

wherein sign[i] is sign information of the i-th sample which is obtained by G.711 decoding.

Figure 11:
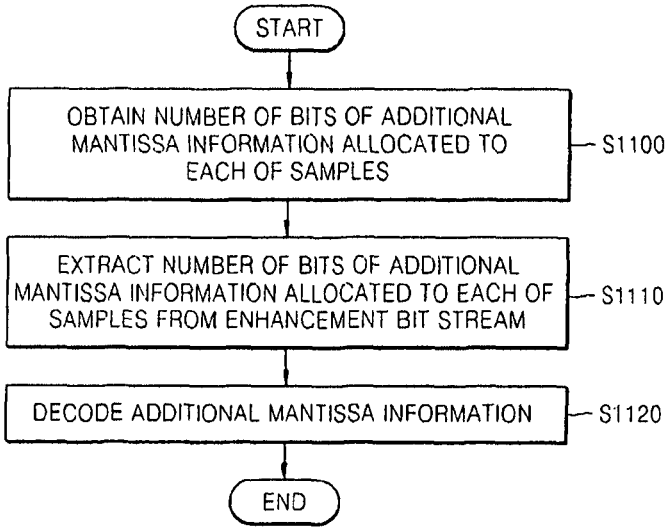
FIG. 11 is a flowchart illustrating a method of decoding an enhancement layer according to an embodiment of the present invention.

FIG. 11 is a flowchart illustrating a method of decoding an enhancement layer according to an embodiment of the present invention.

Referring to FIG. 11, in operation S1100, an enhancement layer decoder obtains the number of additional bits allocated to each sample by using the maximum number of available bits and exponent values in a frame obtained by a G.711 decoding unit. In operation S1110, the enhancement layer decoder extracts additional mantissa information, as many as the number of the additional bits allocated to each sample, from an enhancement bitstream. In operation S1120, the enhancement layer decoder restores additional mantissa information.

The present invention may be embodied as computer-readable codes on a computer-readable recording medium. The computer-readable recording medium is any data storage device that can store data which can be thereafter read by a computer system. Examples of the computer-readable recording medium include read-only memories (ROMs), random-access memories (RAMs), CD-ROMs, magnetic tapes, floppy disks, and optical data storage devices. The computer-readable recording medium can be dispersively installed in a computer system connected to a network, and stored and executed as a computer-readable code in a distributed computing environment.

While the present invention has been particularly shown and described with reference to exemplary embodiments thereof using specific terms, the embodiments and terms have been used to explain the present invention and should not be construed as limiting the scope of the present invention defined by the claims. Accordingly, it will be understood by those of ordinary skill in the art that various changes in form and details may be made therein without departing from the spirit and scope of the present invention as defined by the following claims.

The invention claimed is:

1. A method of encoding an enhancement layer, the method comprising:

calculating exponent indices of additional mantissa information of each sample based on exponent information of each sample in a frame;

repeating a process of allocating 1 bit to each sample with a current exponent index starting from the maximum value while decreasing by 1 at every repetition until the total number of bits allocated to the samples is equal to the total number of available bits in the frame; and extracting the most significant bit(s), as many as the number of bit(s) allocated to each sample, from the additional mantissa information of each sample in the frame.

2. The method of claim 1, wherein the calculating of the exponent indices comprises setting values, which are proportional to the exponent value of each sample and are as many as the number of bits for the additional mantissa information, as exponent indices of the additional mantissa information of each sample.

3. The method of claim 2, wherein the calculating of the exponent indices comprises setting exponent indices of the additional mantissa information to values incremented by a step of 1 starting from the exponent value of a sample.

4. The method of claim 1, wherein the repeating of the process comprises:

setting the maximum value of the exponent indices as the current exponent index;

comparing the number of samples with the current exponent index with the number of available bits in the frame, and setting the number of usable bits to the smaller one of the two numbers;

sequentially allocating 1 bit to each sample with the current exponent index under the budget of the usable bits;

updating the number of available bits to value obtained by subtracting the number of usable bits from the number of available bits;

checking if the updated number of available bits is 0(zero) or not; and if the updated number of available bits is not zero, decrementing the current exponent index by 1 and going back to the step of setting the number of usable bits.

5. The method of claim 1, wherein the number of bits of the additional mantissa information is 3.

6. The method of claim 1, wherein the exponent information is obtained by G.711 encoding.

7. An enhancement layer encoder comprising:

an exponent map generating unit generating an exponent map that is a matrix, including: exponent indices of additional mantissa information derived from exponent value of each sample, and sample indices for each sample in a frame;

a bit allocation table generating unit generating a bit allocation table containing the number of bits allocated to each sample by referring to the exponent map, in the way of repeating a process of allocating 1 bit to each sample with a respective exponent index starting from the maximum value while decreasing by 1 at every repetition until the total number of bits allocated to the samples is equal to the total number of available bits in the frame; and a bit output unit outputting the most significant bit(s), as many as the number of the bits allocated to each sample, from the additional mantissa information of each sample by referring to the bit allocation table.

8. The enhancement layer encoder of claim 7, wherein the exponent map generating unit sets values, which are proportional to the exponent value of each sample and are as many as the number of bits for the additional mantissa information, as exponent indices of the additional mantissa information.

9. The enhancement layer encoder of claim 8, wherein the exponent map generating unit sets exponent indices of the additional mantissa information to values incremented by a step of 1 starting from the exponent value.

10. The enhancement layer encoder of claim 7, wherein, if a difference between the total number of available bits in the frame and the total number of bits allocated to the samples so far is less than the number of samples with a current exponent index, the bit allocation table generating unit allocates 1 bit to each sample with the current exponent index respectively until the difference number of bits are exhausted.

11. The enhancement layer encoder of claim 7, wherein the bit output unit outputs [the additional mantissa information of each of the samples]/2^ [the number of the bits for the additional mantissa information−the number of the bits allocated to each sample].

12. The enhancement layer encoder of claim 7, wherein the additional mantissa information comprises 3 bits.

13. The enhancement layer encoder of claim 7, wherein the exponent value is obtained by G.711 encoding.

14. An encoder comprising:

a G.711 encoding unit encoding an input frame;

an enhancement layer encoding unit encoding the input frame in the way dynamically allocating the number of bits for additional mantissa information to each sample in the input frame based on a exponent information of each sample which is obtained from the G.711 encoding unit; and a multiplexing unit multiplexing bitstream of the G.711 encoding unit and bitstream of the enhancement layer encoding unit.

15. The encoder of claim 14, wherein the enhancement layer encoding unit calculates exponent indices for the additional mantissa information of each sample using the exponent value of each sample, repeats a process of allocating 1 bit to each sample with a current exponent index starting from the maximum value while decreasing by 1 at every repetition until the total number of bits allocated to the samples is equal to the total number of available bits in the frame, and outputs the most significant bit(s), as many as the number of the bit(s) allocated to each sample, from the additional mantissa information of each sample in the frame.

16. A method of decoding an enhancement layer, the method comprising:

calculating exponent indices of additional mantissa information of each sample in a frame based on exponent information of each sample;

repeating a process of allocating 1 bit to each sample with a current exponent index starting from the maximum while decreasing by 1 at every repetition until the total number of bits allocated to the samples is equal to the total number of available bits in the frame; and extracting an additional mantissa bit(s) of number of bits allocated to a sample from an enhancement bitstream and decoding the extracted additional mantissa bits.

17. The method of claim 16, wherein the calculating of the exponent indices comprises setting values, which are proportional to the exponent value of each sample and are as many as the number of bits for the additional mantissa information, as exponent indices of the additional mantissa information of each sample.

18. The method of claim 17, wherein the calculating of the exponent indices comprises setting exponent indices of the additional mantissa information to values incremented by a step of 1 starting from the exponent value.

19. The method of claim 17, wherein the repeating of the process comprises:

setting value of the exponent indices as the current exponent index;

comparing the number of samples with the current exponent index with the number of available bits in the frame, and setting the number of usable bits to the smaller one of the two numbers;

sequentially allocating 1 bit to each sample with the current exponent index under the budget of the usable bits;

updating the number of available bits to value obtained by subtracting the number of usable bits from the number of the available bits;

checking if the updated number of available bits is 0 or not; and if the updated number of available of bits is not zero, decrementing the current exponent index by 1 and going back to the step of setting the number of usable bits.

20. An enhancement layer decoder comprising:

an exponent map generating unit generating an exponent map that is a matrix, including: exponent indices of additional mantissa information derived from exponent value of each sample, and sample indices for each sample in a frame;

a bit allocation table generating unit generating a bit allocation table containing the number of bits allocated to each sample by referring to the exponent map, in the way of repeating a process of allocating 1 bit to each sample with a respective exponent index starting from the maximum value while decreasing by 1 at every repetition until the total number of bits allocated to the samples is equal to the total number of available bits in the frame; and an additional mantissa decoding unit extracting an additional mantissa bit(s), as many as the number of bits allocated to each sample, from an enhancement bitstream by referring to the bit allocation table and decoding the additional mantissa bits.

21. The enhancement layer decoder of claim 20, wherein the exponent map generating unit sets values, which are proportional to the exponent value of each sample and are as many as the number of bits for the additional mantissa information, as exponent indices of the additional mantissa information.

22. The enhancement layer decoder of claim 21, wherein the exponent map generating unit sets exponent indices of the additional mantissa information to values incremented by a step of 1 starting from the exponent value.

23. The enhancement layer decoder of claim 20, wherein, if a difference between the total number of available bits in the frame and the total number of bits allocated to the samples so far is less than the number of samples with a current exponent index, the bit allocation table generating unit allocates 1 bit to each sample with the current exponent index until the difference number of bits are exhausted.

24. A decoder comprising:

a demultiplexing unit demultiplexing a received frame to a G.711 bitstream and an enhancement bitstream;

a G.711 decoding unit decoding the G.711 bitstream;

an enhancement layer decoding unit calculating the number of bits for additional mantissa information allocated to each sample using exponent value of each sample obtained from the G.711 decoding unit, extracting an additional mantissa bits of number of bits allocated to a sample from an enhancement bitstream, and decoding the extracted additional mantissa bits; and a signal synthesizing unit combining an output signal of the G.711 decoding unit and an output signal of the enhancement layer decoding unit to output the synthesized signal.

25. The decoder of claim 24, wherein exponent indices of the additional mantissa information of each sample are calculated using the exponent value of each sample, and 1 bit is respectively allocated to each sample with a current exponent index starting from the maximum value of the exponent index while decreasing by 1 at every repetition until the total number of bits allocated to the samples is equal to the total number of available bits in the frame, and thereupon the additional mantissa information of the number of the bits allocated to each sample are extracted from the enhancement bitstream.

26. A method of encoding an enhancement layer in a hierarchical encoding combined with a base layer including exponent information and mantissa information of a sample, the method comprising, calculating the number of allocated bits for additional mantissa information to extend the mantissa information; and encoding the additional mantissa information according to the number of the allocated bits, wherein the calculating the number of allocated bits is adaptively performed by referring to exponent information of samples existing in an interval of predetermined length.

27. The method of claim 26, wherein the calculating the number of allocated bits is adaptively performed according to the relative magnitude of exponents of samples existing in a frame.

28. The method of claim 27, wherein the allocating of the bits comprises allocating bits according to the priorities based on the exponents of samples, wherein the number of bits allocated to one sample does not exceed a predetermined value.

29. The method of claim 27, wherein the calculating the number of allocated bits comprises:

generating an exponent map using the range of the exponents, the maximum number of bits to be allocated to each sample, and the number of samples per frame; and calculating the number of bits allocated to each sample using the exponent map.

30. A method of decoding an enhancement layer signal in a hierarchically encoded bitstream comprising a base layer bitstream, which includes exponent information and mantissa information of a sample, and an enhancement layer bitstream, which includes additional mantissa information of the sample, the method comprising:

calculating the number of bits allocated to each sample for the additional mantissa information, based upon the exponent information extracted from the base layer bitstream; and extracting the additional mantissa information of the calculated number of the bits allocated to each sample from the enhancement layer bitstream.

31. The method of claim 30, wherein the calculating of the number of the bits is adaptively performed according to the relative magnitude of exponents of samples existing in a frame.

32. The method of claim 31, wherein the calculating of the number of the bits comprises allocating bits according to the priorities, based on the exponents of samples, wherein the number of bits allocated to one sample does not exceed a predetermined value.

33. The method of claim 31, wherein the calculating of the number of the bits comprises:

generating an exponent map using the range of the exponents, the maximum number of bits to be allocated per sample, and the number of samples per frame; and calculating the number of bits allocated to each sample using the exponent map.

* * * * *